US009538584B2

(12) United States Patent
Cho et al.

(10) Patent No.: US 9,538,584 B2
(45) Date of Patent: Jan. 3, 2017

(54) TAPPING DEVICE AND METHOD USING INDUCTION HEAT FOR MELT

(71) Applicant: KOREA HYDRO & NUCLEAR POWER CO., LTD., Gyeongsangbuk-do (KR)

(72) Inventors: Hyun Je Cho, Daejeon (KR); Cheon Woo Kim, Daejeon (KR); Young Il Kim, Daejeon (KR); Sang Woo Lee, Daejeon (KR); Seung Chul Park, Daejeon (KR); Jong Gil Park, Gyeonggi-do (KR); Tae Won Hwang, Daejeon (KR)

(73) Assignee: KOREA HYDRO & NUCLEAR POWER CO., LTD., Gyeongju-si, Gyeongsangbuk-do (KR)

( * ) Notice: Subject to any disclaimer, the term of this patent is extended or adjusted under 35 U.S.C. 154(b) by 320 days.

(21) Appl. No.: 14/143,495

(22) Filed: Dec. 30, 2013

(65) Prior Publication Data

US 2015/0098484 A1 Apr. 9, 2015

(30) Foreign Application Priority Data

Oct. 4, 2013 (KR) ..... 10-2013-0118577

(51) Int. Cl.

| | |
|---|---|
| ***F27D 3/00*** | (2006.01) |
| ***H05B 6/22*** | (2006.01) |
| ***H05B 6/24*** | (2006.01) |
| ***H05B 6/34*** | (2006.01) |
| ***F27B 3/19*** | (2006.01) |
| ***F27B 3/20*** | (2006.01) |

(Continued)

(52) U.S. Cl.

CPC . *H05B 6/24* (2013.01); *F27B 3/19* (2013.01); *F27B 3/20* (2013.01); *F27B 3/28* (2013.01); *F27D 3/1509* (2013.01); *F27D 9/00* (2013.01); *F27D 21/0028* (2013.01); *H05B 6/34* (2013.01)

(58) Field of Classification Search

CPC ..... F27B 14/0806; F27B 14/061; F27B 3/19; F27B 3/20; F27B 3/28; H05B 6/24; H05B 6/34; F27D 21/0028; F27D 9/00; F27D 3/1509; F27D 3/159

USPC ..... 373/4, 7, 142, 143, 138, 152, 155, 156, 373/157; 266/45, 237, 239, 240

See application file for complete search history.

(56) References Cited

U.S. PATENT DOCUMENTS

| | | | | |
|---|---|---|---|---|
| 5,898,727 | A * | 4/1999 | Fujikawa | C23C 14/5806 373/110 |
| 5,939,016 | A * | 8/1999 | Mathiesen | B22D 41/60 266/237 |
| 2008/0258102 | A1* | 10/2008 | Hirose | B22F 1/02 252/62.51 R |

FOREIGN PATENT DOCUMENTS

| | | |
|---|---|---|
| EP | 0176898 | 4/1986 |
| JP | 1989-219495 A | 9/1989 |

(Continued)

OTHER PUBLICATIONS

Finnish Office Action dated Jan. 22, 2016.

*Primary Examiner* — Hung D Nguyen
(74) *Attorney, Agent, or Firm* — Rabin & Berdo, P.C.

(57) ABSTRACT

A tapping device and method using induction heat for melt comprises melting furnace made of steel; heating unit disposed in the upper part in the melting furnace and made of graphite material; induction coil wound around the heating unit; insulator disposed adjacent to the bottom surface of the lower part of the melting furnace; supporter disposed outside (Continued)

the insulator; and firebricks disposed on the bottom surface of melting furnace and outside the supporter.

16 Claims, 2 Drawing Sheets

(51) Int. Cl.

| | |
|---|---|
| ***F27B 3/28*** | (2006.01) |
| ***F27D 3/15*** | (2006.01) |
| ***F27D 9/00*** | (2006.01) |
| ***F27D 21/00*** | (2006.01) |

(56) References Cited

FOREIGN PATENT DOCUMENTS

| | | | |
|---|---|---|---|
| JP | H 02137646 | A | 5/1990 |
| JP | 2000-348851 | A | 12/2000 |
| JP | 2001-141225 | A | 5/2001 |
| JP | 2003-105415 | A | 4/2003 |

* cited by examiner

TAPPING DEVICE AND METHOD USING INDUCTION HEAT FOR MELT

TECHNICAL FIELD

The present invention relates to a tapping device and method using induction heat for melt, and more particularly, to a tapping device and method using induction heat for melt, which is partially discharged by disposing melt tapping hole in the lower part of melting furnace, and installing melt tapping hole higher than the bottom of melting furnace.

BACKGROUND ART

The In general as a method to discharge melt inside melting furnace, tilting melting furnace itself or passing over overflow-dam in the upper part in melting furnace is used.

In addition, there is a method to discharge melt inside melting furnace by removing plug mounted on melt outlet or securing outlet with oxygen welding heat or oxidation heat of oxygen lance.

Recently, tapping method using induction heating method is under development and precisely there is respectively characteristic equipment unit.

Particularly, for PEM or IET in the U.S. tapping is performed using the side of flat bottom level of melting furnace in induction heating method.

Those tapping devices and methods for melt as described above are mostly for tapping melt of viscosity which is low or easy to be maintained like glass, and they are not proper for highly viscous material.

Particularly, in case of melt or glass-ceramic melt, its viscosity characteristic is distinctly different from glass melt, thus when it is exposed to outside through tapping hole, viscosity of melt grows rapidly and tapping can be stopped or become unsmooth.

And even if tapping can be performed, there is a problem that a container for melt is not be fully filled, melt is coming up like growing stalagmite.

DISCLOSURE

Technical Problem

Accordingly, the present invention is devised to solve the problem as described above, and to provide a tapping device and method using induction heat for melt of which structure is configured to dispose melt tapping hole in the lower part of melting furnace and install the melt tapping hole higher than the bottom of melting furnace for preventing melt from being discharged completely. Thus a fixed quantity of molten metal is maintained to increase thermal efficiency and melting speed and prevent electrode disposed on the bottom of melting furnace from being exposed to plasma of high temperature and easily consumed.

Technical Solution

In order to acquire the objective as described above, a tapping device and method using induction heat for melt according to the present invention is characterized by comprising melting furnace made of steel; heating unit disposed in the upper part in the melting furnace and made of graphite material; induction coil wound around the heating unit; insulator disposed adjacent to the bottom surface of the lower part of the melting furnace; supporter disposed outside the insulator; firebricks disposed on the bottom surface of melting furnace and outside the supporter.

And also in order to acquire the objective as described above, a tapping method for melt using induction heat ,wherein the method comprises the steps of melting the solidified melt inside tapping hole and discharging it downwards by gravity using a tapping device of melting furnace comprising melting furnace made of steel; heating unit disposed in the upper part in the melting furnace and made of graphite material; induction coil wound around the heating unit; insulator disposed adjacent to the bottom surface of the lower part of the melting furnace; supporter disposed outside the insulator; and firebricks disposed outside the supporter and on the bottom surface of melting furnace.

Advantageous Effects

As explained above, a tapping device and method using induction heat for melt according to the present invention have the advantages as follow.

First, in the present invention of which structure is configured to prevent melt from being discharged completely by disposing melt tapping hole in the lower part of melting furnace and installing the tapping hole higher than the floor of melting furnace. Thus a fixed quantity of molten metal is maintained to increase thermal efficiency and melting speed and prevent electrode disposed on the bottom of melting furnace from being exposed to plasma of high temperature and easily consumed.

Secondly, there is advantage that tapping for melt can be adjusted as required, thus plasma melting process can be automated.

Thirdly, there is advantage that driver's proximity job can be omitted, thus driving security is improved.

DESCRIPTION OF THE REFERENCE NUMERALS IN THE DRAWINGS

Figure 1:
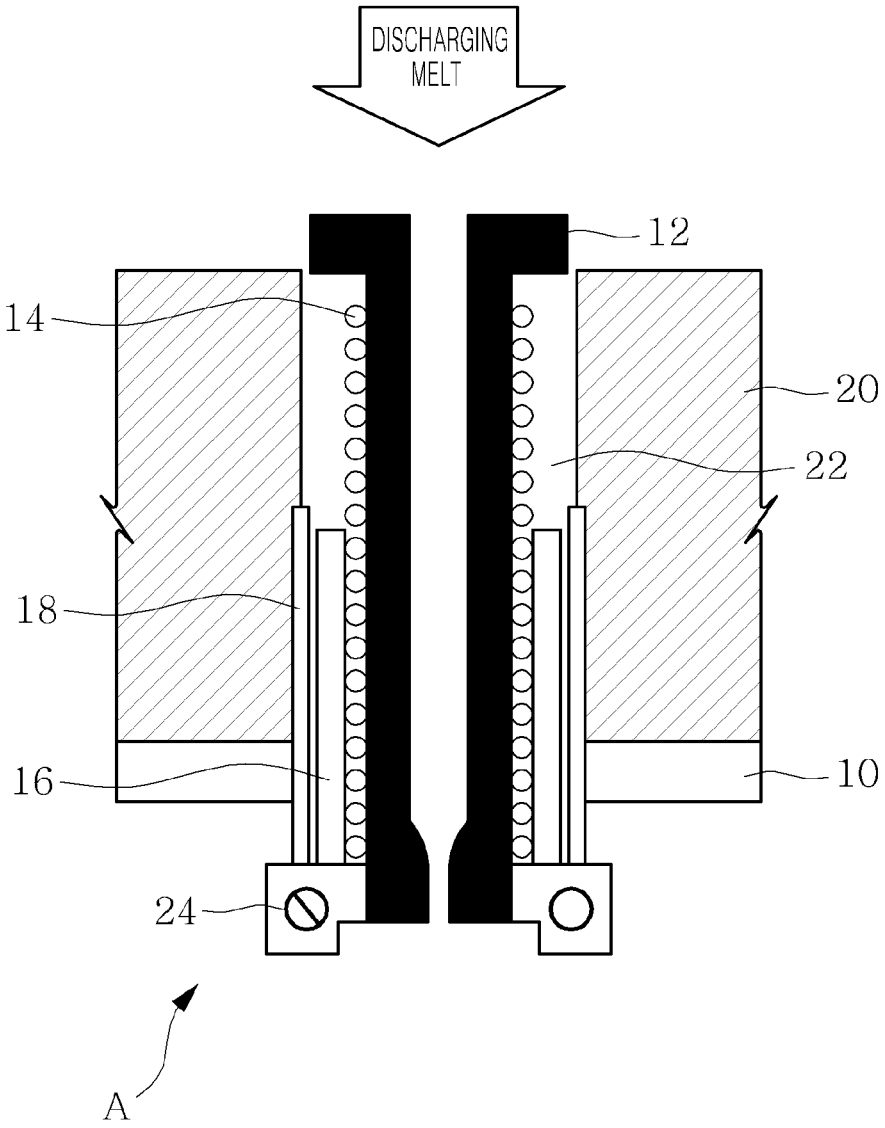
FIG. 1 is a schematic diagram showing induction tapping equipment for melt according to the present invention.

10: melting furnace
12: heating unit
14: induction coil
16: insulator
18: supporter
20: firebricks
22: melt tapping hole
24: coolant flow channel
A: induction tapping equipment for melt

BEST MODE

Specific features and advantages of the present invention will be more clearly understood from the following detailed description when taken in conjunction with the accompanying drawings.

Figure 2:
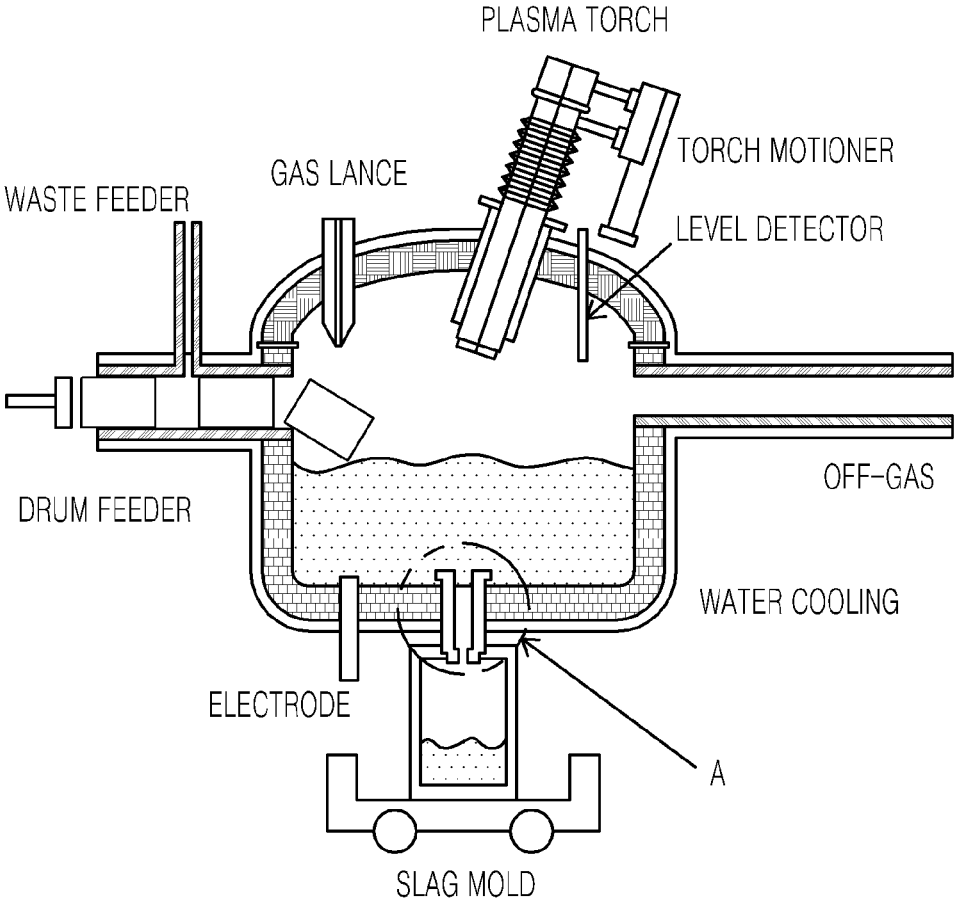
FIG. 2 is a conceptual diagram showing a state that induction tapping equipment for melt according to the present invention is installed in melting furnace.

FIG. 1 is a schematic diagram showing induction tapping equipment for melt according to the present invention, and FIG. 2 is a conceptual diagram showing a state that induction tapping equipment for melt according to the present invention is installed in melting furnace.

As shown in these figures, induction tapping equipment for melt according to the present invention comprises melting furnace (10) made of steel material; heating unit (12) disposed in the upper part in the melting furnace and made of graphite material; induction coil (14) wound around the heating unit (12); insulator (16) disposed adjacent to the bottom surface of the lower part of the melting furnace (10); supporter disposed outside the insulator (16); firebricks disposed on the bottom surface of melting furnace and outside the supporter (20).

Thus, induction tapping equipment(A) according to the present invention is an equipment comprising melting furnace (10), heating unit (12), induction coil (14), insulator (16), supporter (18), firebricks (20), and melt tapping hole (22), which are organically combined together.

Here, the melting furnace (10) is formed of steel material.

Further, the heating unit (12) is formed of high density graphite material, and the surface of graphite is coated with molybdenum ($MoSi_2$) or silicon carbide (SiC).

In particular, the upper part of the heating unit (12) is disposed to be higher than the bottom of melting furnace (10) so that heat can be transferred to melt directly, and in order to align the form of dam and maintain high temperature of melt in the lower part of the melting furnace (10), tapping is performed while being heated. And, the induction coil (14) is wound around the heating unit (12).

And the insulator (16) is disposed adjacent to the bottom surface of the lower part of the melting furnace. And the supporter (18) is disposed outside the insulator (16).

And the firebricks (20) is disposed outside the supporter (18) and on the bottom surface of melting furnace (10).

And melt tapping hole (22), outlet for melt, is formed between the upper part of induction coil(14) and firebricks (20), and the melt tapping hole (22) is formed of alumina refractories, and core of ferrite material as insulator (16) is attached outside induction coil (14) to block heat transference to the metal in lower part of melting furnace (10), and the outside of the melt tapping hole (22) is configured to be supported by supporter (18) made of metal.

And the melt tapping hole (22) is heated by attaching high-frequency induction coil (14) to heating unit (12) made of graphite material, and the melt tapping hole (22) is heated to transfer heat to melt the solidified melt inside tapping hole and to discharge melted molten melt downwards by gravity.

Here, the melt tapping hole (22) is disposed in the lower part of melting furnace (10), and the melt tapping hole (22) is installed higher than the bottom of melting furnace (10) to structurally prevent melt from being discharged completely.

The reason for this is to increase thermal efficiency and melting speed and prevent electrode disposed on the bottom of melting furnace (10) from being exposed to plasma of high temperature and easily consumed by maintaining fixed quantity of molten metal all the time.

Meanwhile, coolant flow channel (24) is formed to make coolant flow under insulator (16) for temperature control of the heating unit (12) and cooling down while tapping is halted.

Hereinafter, the operation of induction tapping equipment for melt with composition as described above is explained in detail.

As shown in FIG. 1 and FIG. 2, according to the present invention induction tapping method for melt is to melt solidified melt inside melt tapping hole (22) and discharge downwards by gravity using induction tapping equipment (A) of melting furnace comprising melting furnace (10) made of steel; heating unit (12) disposed in the upper part in the melting furnace (10) and made of graphite material; induction coil (14)wound around the heating unit (12); insulator (16) disposed adjacent to the bottom surface of the lower part of the melting furnace (16); supporter (18) disposed outside the insulator; and firebricks (20) disposed outside the supporter (18) and on the bottom surface of melting furnace (10).

In addition, the upper part of the heating unit (12) is disposed to be higher than the bottom of melting furnace (10) so that heat can be transferred to melt directly and in order to align the form of dam and maintain high temperature of melt in the lower part of the melting furnace (10), tapping is performed while being heated.

Induction tapping method for melt according to the present invention with composition as described above is to discharge melt partially by disposing melt tapping hole (22) in the lower part of melting furnace (10) and installing the tapping hole (22) higher than the bottom of melting furnace (10). Thus it has effective action that a fixed quantity of molten metal is maintained to increase thermal efficiency and melting speed and prevent electrode disposed on the bottom of melting furnace from being exposed to plasma of high temperature and easily consumed.

What is claimed is:

1. A tapping device for melt using induction heat, comprising:

a melting furnace(10) made of steel material;

firebricks(20) disposed on a bottom surface of the melting furnace(10), the firebricks(20) including a lower surface in contact with the bottom surface of the melting furnace(10) and an upper surface opposite to the lower surface;

a heating unit(12) disposed in the melting furnace(10) and made of graphite material, wherein an upper end of the heating unit(12) is disposed above a level at which the upper surface of the firebricks(20) is disposed;

an induction coil(14) wound around the heating unit(12);

an insulator(16) disposed adjacent to the bottom surface of the melting furnace(10); and a supporter(18) disposed outside the insulator(16), wherein the firebricks(20) are disposed outside the supporter(18), wherein the firebricks(20) include two opposite side surfaces which are apart from each other by a gap; and the induction coil(14) is disposed in the gap to face the two opposite side surfaces.

2. The tapping device of claim 1, wherein the surface of the heating unit(12) is coated with molybdenum($MoSi_2$).

3. The tapping device of claim 2, wherein coolant flow channel(24) is formed to make coolant flow under insulator (16) for temperature control of the heating unit(12) and cooling down while tapping is halted.

4. The tapping device of claim 1, wherein the surface of the heating unit(12) is coated with silicon carbide(SiC).

5. The tapping device of claim 4, wherein coolant flow channel(24) is formed to make coolant flow under insulator (16) for temperature control of the heating unit(12) and cooling down while tapping is halted.

6. The tapping device of claim 1, wherein melt tapping hole(22) is formed in the upper part of induction coil(14) and firebricks(20), and the melt tapping hole(22) is made of alumina refractories.

7. The tapping device of claim 1, wherein the insulator (16) is formed of core of ferrite material.

8. The tapping device of claim 1, wherein coolant flow channel(24) is formed to make coolant flow under insulator (16) for temperature control of the heating unit(12) and cooling down while tapping is halted.

9. A tapping method for melt using induction heat, wherein the method comprises steps of melting solidified melt inside a melt tapping hole(22) and discharging the melt downwards by gravity using a tapping device(A), wherein the tapping device(A) comprises:

a melting furnace(10) made of steel material;

firebricks(20) disposed on a bottom surface of the melting furnace(10), the firebricks(20) including a lower surface in contact with the bottom surface of the melting furnace(10) and an upper surface opposite to the lower surface;

a heating unit(12) disposed in the melting furnace(10) and made of graphite material, wherein an upper end of the heating unit(12) is disposed above a level at which the upper surface of the firebricks(20) is disposed;

an induction coil(14) wound around the heating unit(12);

an insulator(16) disposed adjacent to the bottom surface of the melting furnace(10); and a supporter(18) disposed outside the insulator(16), wherein the firebricks(20) are disposed outside the supporter(18), wherein the firebricks(20) include two opposite side surfaces which are apart from each other by a gap; and the induction coil(14) is disposed in the gap to face the two opposite side surfaces.

10. The tapping method of claim 9, wherein the surface of the heating unit(12) is coated with molybdenum($MoSi_2$).

11. The tapping method of claim 10, wherein coolant flow channel(24) is formed to make coolant flow under insulator (16) for temperature control of the heating unit(12) and cooling down while tapping is halted.

12. The tapping method of claim 9, wherein the surface of the heating unit(12) is coated with silicon carbide(SiC).

13. The tapping method of claim 12, wherein coolant flow channel(24) is formed to make coolant flow under insulator (16) for temperature control of the heating unit(12) and cooling down while tapping is halted.

14. The tapping method of claim 9, wherein melt tapping hole(22) is formed in the upper part of induction coil(14) and firebricks(20), and the melt tapping hole(22) is made of alumina refractories.

15. The tapping method of claim 9, wherein the insulator (16) is formed of core of ferrite material.

16. The tapping method of claim 9, wherein coolant flow channel(24) is formed to make coolant flow under insulator (16) for temperature control of the heating unit(12) and cooling down while tapping is halted.

* * * * *